US011085383B2

(12) United States Patent
Buerger et al.

(10) Patent No.: US 11,085,383 B2
(45) Date of Patent: Aug. 10, 2021

(54) CONTROL UNIT FOR ADAPTING THE EMISSION OF A VEHICLE

(71) Applicant: Bayerische Motoren Werke Aktiengesellschaft, Munich (DE)

(72) Inventors: Johannes Buerger, Munich (DE); Dagmar Mutzel, Munich (DE); Thomas Salcher, Woerthsee (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 7 days.

(21) Appl. No.: 16/533,990

(22) Filed: Aug. 7, 2019

(65) Prior Publication Data

US 2019/0360414 A1 Nov. 28, 2019

Related U.S. Application Data

(63) Continuation of application No. PCT/EP2018/054689, filed on Feb. 26, 2018.

(30) Foreign Application Priority Data

Mar. 8, 2017 (DE) ..... 10 2017 203 849.7

(51) Int. Cl.
*F02D 41/02* (2006.01)
*F02D 41/14* (2006.01)

(52) U.S. Cl.
CPC ..... *F02D 41/021* (2013.01); *F02D 41/1462* (2013.01); *F02D 41/1465* (2013.01); (Continued)

(58) Field of Classification Search
CPC ..... F02D 41/021; F02D 41/1462; F02D 41/1465; F02D 41/1453; F02D 41/1459; (Continued)

(56) References Cited

U.S. PATENT DOCUMENTS 6,112,151 A * 8/2000 Kruse ..... F02D 41/2422 180/167
8,359,829 B1 * 1/2013 Ramberg ..... F02D 41/1453 60/285

(Continued)

FOREIGN PATENT DOCUMENTS

DE 10 2008 025 569 A1 12/2009
DE 10 2009 000 970 A1 8/2010

(Continued)

OTHER PUBLICATIONS

International Search Report (PCT/ISA/210) issued in PCT Application No. PCT/EP2018/054689 dated May 29, 2018 with English translation (six (6) pages).

(Continued)

*Primary Examiner* — Sizo B Vilakazi
*Assistant Examiner* — Brian R Kirby
(74) *Attorney, Agent, or Firm* — Crowell & Moring LLP

(57) ABSTRACT

A control unit is provided for a vehicle having an internal combustion engine which generates exhaust gases when a fuel is burnt. The vehicle has a multiplicity of emission-relevant functions by which a quantity of emissions in the exhaust gases can be changed. The control unit is configured to determine a planning emission value for a planning time period, wherein the planning emission value indicates the quantity of emissions in the exhaust gases in the planning time period. The control unit is further configured to operate the multiplicity of emission-relevant functions within the planning time period as a function of the planning emission value.

20 Claims, 1 Drawing Sheet

(52) U.S. Cl.
CPC ..... *F02D 41/1453* (2013.01); *F02D 41/1459* (2013.01); *F02D 2041/1412* (2013.01); *F02D 2041/1433* (2013.01); *F02D 2200/701* (2013.01)

(58) Field of Classification Search
CPC ..... F02D 2041/1412; F02D 2041/1433; F02D 2200/701; F02D 41/1444
USPC ..... 701/102–109
See application file for complete search history.

(56) References Cited

U.S. PATENT DOCUMENTS

| | | | | |
|---|---|---|---|---|
| 2003/0135323 | A1* | 7/2003 | Votsmeier | F02D 41/021 701/115 |
| 2009/0056313 | A1* | 3/2009 | Kama | F02D 41/1441 60/277 |
| 2010/0043404 | A1* | 2/2010 | Hebbale | F01N 9/00 60/286 |
| 2010/0211247 | A1 | 8/2010 | Sherony | |
| 2012/0124973 | A1* | 5/2012 | Lee | F02D 41/1462 60/287 |
| 2012/0232731 | A1* | 9/2012 | Sujan | B60W 10/08 701/22 |
| 2013/0131967 | A1* | 5/2013 | Yu | F01N 9/005 701/115 |
| 2017/0167347 | A1* | 6/2017 | Sun | F01N 11/00 |
| 2017/0168466 | A1* | 6/2017 | Sun | G05B 13/048 |
| 2017/0356350 | A1* | 12/2017 | Li | F02D 11/02 |
| 2018/0202373 | A1* | 7/2018 | Herbst | F02D 41/1462 |
| 2018/0274467 | A1* | 9/2018 | Garimella | F02D 35/02 |

FOREIGN PATENT DOCUMENTS

| | | | | |
|---|---|---|---|---|
| DE | 10 2013 000 548 | B3 | 4/2014 | |
| DE | 10 2013 200 505 | A1 | 7/2014 | |
| DE | 10 2014 209 316 | A1 | 11/2015 | |
| DE | 10 2016 201 129 | A1 | 8/2016 | |
| DE | 10 2015 014 150 | A1 | 11/2016 | |
| DE | 102015014150 | A1 * | 11/2016 | F02D 41/0235 |
| DE | 10 2015 215 928 | A1 | 2/2017 | |
| EP | 0 859 132 | A1 | 8/1998 | |
| GB | 2531368 | A | 4/2016 | |
| GB | 2535247 | A * | 8/2016 | F02D 41/26 |
| WO | WO 2016/174015 | A1 | 11/2016 | |

OTHER PUBLICATIONS

German-language Written Opinion (PCT/ISA/237) issued in PCT Application No. PCT/EP2018/054689 dated May 29, 2018 (eight (8) pages).

German-language Search Report issued in counterpart German Application No. 10 2017 203 849.7 dated Sep. 26, 2017 with partial English translation (16 pages).

* cited by examiner

CONTROL UNIT FOR ADAPTING THE EMISSION OF A VEHICLE

CROSS REFERENCE TO RELATED APPLICATIONS

This application is a continuation of PCT International Application No. PCT/EP2018/054689, filed Feb. 26, 2018, which claims priority under 35 U.S.C. § 119 from German Patent Application No. 10 2017 203 849.7, filed Mar. 8, 2017, the entire disclosures of which are herein expressly incorporated by reference.

BACKGROUND AND SUMMARY OF THE INVENTION

The invention relates to a control unit for adapting emissions, in particular pollutant emissions, of a vehicle.

A vehicle having an internal combustion engine, in particular having a spark-ignition engine, comprises a multiplicity of different functions which each have an influence on the pollutant emissions of the vehicle. For example, there are functions of on-board diagnostics (OBD) which monitor the components of the lambda probe or catalytic converter of the exhaust system of the vehicle, inter alia, by selectively changing the fuel/air mixture (in particular the lambda value) of the internal combustion engine. Furthermore, there are functions for ensuring the driving comfort or for reducing the fuel consumption, which functions can bring about a rise in the emissions of the vehicle, such as e.g. an individual cylinder cutoff or an overrun cutoff of the internal combustion engine.

The emissions of pollutants of a vehicle with an internal combustion engine (in particular with a spark-ignition engine) are therefore influenced by a multiplicity of different functions of the vehicle. The present document is concerned with the technical problem of optimizing the emissions of pollutants of a vehicle, in particular with respect to, possibly legally prescribed, limiting values.

The object is achieved by means of the features of the independent patent claim. Advantageous embodiments are described, inter alia, in the dependent claims. Reference is made to the fact that additional features of a patent claim which is dependent on an independent patent claim can form, without the features of the independent patent claim or only in combination with a subset of the features of the independent patent claim, a separate invention which is independent of the combination of all the features of the independent patent claim and which can be made the subject matter of an independent claim, a partial application or a subsequent application. This applies in the same way to technical teachings which are described in the description and which can form an invention which is independent of the features of the independent patent claims.

According to one aspect, a control unit for a vehicle (in particular for a motor vehicle) is described. The vehicle comprises at least one internal combustion engine which generates exhaust gases when fuel is burnt. The internal combustion engine can be, in particular, a spark-ignition engine which is operated with gasoline as the fuel. Alternatively, the internal combustion engine can be a diesel engine. The exhaust gases from the internal combustion engine are typically conducted out of the vehicle via an exhaust system of the vehicle. In this context, the exhaust system usually comprises a catalytic converter (e.g. a three-way catalytic converter) which is configured to reduce the quantity of emissions in the exhaust gases from the internal combustion engine. The emissions (which can also be referred to as emissions of pollutants) comprise here, in particular, nitrogen oxides ($NO_x$), e.g. nitrogen monoxide (NO), carbon monoxide (CO) and/or hydrocarbons (e.g. $C_2H_6$). Carbon dioxide ($CO_2$) is not considered to be an emission in this document.

The vehicle can comprise a multiplicity of emission-relevant functions by which the quantity of emissions in the exhaust gases can be changed (in particular the quantity of emissions which pass into the environment). In this case, an emission-relevant function can be such that the activation or the deactivation of the emission-relevant function changes the quantity of emissions in the exhaust gases. Alternatively or additionally, an emission-relevant function can be such that the adaptation of an operating parameter and/or of an operating range of the emission-relevant function changes the quantity of emissions in the exhaust gases. Furthermore, an emission-relevant function can be such that the activation and/or the deactivation of the emission-relevant function does not adversely affect the actual driving operation of the vehicle in the planning time period.

The multiplicity of emission-relevant functions can comprise e.g. one or more basic functions for the operation of the internal combustion engine. For example, the quantity of emissions in the exhaust gases of the vehicle can be changed by an overrun cutoff of the internal combustion engine, by scavenging of the internal combustion engine and/or by an individual cylinder cutoff of the internal combustion engine. Further exemplary basic functions are: switching the internal combustion engine to lean operation; overrun burbling of the internal combustion engine; tank ventilation and/or a torque intervention in the internal combustion engine, in particular by a transmission and/or by a secondary consumer.

Alternatively or additionally, the multiplicity of emission-relevant functions can comprise a function for shifting the load point of the internal combustion engine. The shifting of the load point can occur here, in particular, by means of an electric machine of the vehicle. Alternatively or additionally, the multiplicity of emission-relevant functions can comprise one or more diagnostic functions for checking a component of the exhaust system of the vehicle. In particular, a diagnostic function can be made available for checking the lambda probe, the catalytic converter and/or tank ventilation (for ventilating the fuel tank of the vehicle).

Alternatively or additionally, the multiplicity of emission-relevant functions can comprise one or more emission functions for adapting an operating parameter and/or an operating range of a component of the exhaust system of the vehicle. For example, a heating function can be made available for the catalytic converter and/or for the exhaust gases of the internal combustion engine in order to adapt the method of functioning of the catalytic converter (in particular after a cold start and/or when driving in town) with the aim of reducing emissions. Furthermore, the multiplicity of emission-relevant functions can comprise one or more protective functions for protecting a component of the exhaust system of the vehicle, in particular a heating function and/or enable function for the lambda probe of the exhaust system. Further exemplary emission functions are: an active particle filter regeneration; an adaptation of the formation of the fuel/air mixture; an adaptation in an air path of the vehicle; and/or an adaptation of a trim control.

The vehicle can therefore comprise a plurality of different emission-relevant functions which may not be absolutely necessary for the driving operation of the vehicle but by means of which, if appropriate, the fuel consumption of the vehicle can be reduced, but which, on the other hand, can have an adverse effect on the quantity of emissions. In this context, the point in time for the activation of an emission-relevant function may, if appropriate, be flexible (e.g. in the case of a diagnostic function).

The control unit is configured to determine a planning emission value for a planning time period. In this context, the planning time period can lie at least partially (or completely) in the future. For example, the planning time period can start at a current point in time. The planning time period can have a fixed duration. For example the planning time period can be 30, 10, 5 or 2 minutes or 1 minute or less. Alternatively, the planning time period can correspond to a specific (fixed) planning distance traveled by the vehicle (and, if appropriate, have a variable duration). The planning distance traveled can be, for example, 5, 2 or 1 km or less.

The control unit can therefore predict a planning emission value for a planning time period (lying at least partially in the future). In this context, the planning emission value indicates the quantity of emissions in the exhaust gases (which leave the vehicle) in the planning time period. It is therefore possible to predict the quantity of emissions in a planning time period.

The control unit is also configured to operate the multiplicity of emission-relevant functions within the planning time period as a function of the planning emission value. The emissions of pollutants by a vehicle can therefore be reliably monitored and/or adjusted.

In addition, the control unit can be configured to operate the multiplicity of emission-relevant functions within the planning time period also in accordance with a reference emission value for the planning time period. In this context, the reference emission value can indicate a maximum permissible or maximum desired quantity of emissions in the exhaust gases within the planning time period. For example, the planning emission value can be compared with the reference emission value. The multiplicity of emission-relevant functions can then be operated in accordance with the comparison within the planning time period. By taking into account a reference emission value it is possible to achieve reliable limitation of the emissions of a vehicle.

The control unit can be configured to deactivate or activate an emission-relevant function in accordance with the planning emission value. Furthermore, the control unit can be configured to adapt an operating parameter and/or an operating range of an emission-relevant function in accordance with the planning emission value. This can occur, in particular, in such a way that an actual emission value of the vehicle does not exceed the reference emission value in the planning time period.

The control unit can be configured to detect that the actual emission value exceeds the reference emission value in a specific time period. For example an entry can then be made in a fault memory of the vehicle and/or an output can occur to a user of the vehicle.

The vehicle can have a standard operating strategy, wherein the standard operating strategy describes a standard mode of operation of the multiplicity of emission-relevant functions. For example, the standard operating strategy for a diagnostic function can define the one or more points in time (typically periodic or at least repeated points in time) at which the diagnostic function is to be carried out. Furthermore, the standard operating strategy can define for a basic function the conditions under which the basic function is to be activated (e.g. the load of the internal combustion engine, the overrun operation of the internal combustion engine etc.).

The control unit can be configured to determine the planning emission value on the basis of the standard operating strategy of the vehicle for the planning time period. It is therefore possible to determine which planning emission value the vehicle would have in the planning time period if the internal combustion engine, the exhaust system of the vehicle and/or the multiplicity of emission-relevant functions were to operate according to the standard operating strategy.

In addition, the control unit can be configured to operate one or more of the multiplicity of emission-relevant functions in accordance with the planning emission value, in a way which deviates from the standard operating strategy. For example, it is possible to determine that the operation according to the standard operating strategy would lead to the planning emission value exceeding the reference emission value. One or more of the emission-relevant functions can then be made to operate in a way which deviates from the standard operating strategy, with the result that the planning emission value is reduced (and therefore also the actual emissions of the vehicle are reduced). For example, a diagnostic function which is planned in the standard fashion can be shifted to a later planning time period. Alternatively or additionally, shifting of a load point of the internal combustion engine can be carried out. It is therefore possible to ensure in an automatic fashion that predefined emission objectives of the vehicle are complied with.

The emission-relevant functions can have different priorities for the planning time period. In this context, the priorities of the different emission-relevant functions can, if appropriate, change with time. The multiplicity of emission-relevant functions can then also be operated in accordance with the respective current priorities within the planning time period. The emission-oriented operation of the vehicle can therefore be improved further.

The control unit can be configured to determine parameter values of one or more operating parameters of the internal combustion engine and/or of the catalytic converter of the vehicle for the planning time period. The one or more operating parameters can e.g. comprise or indicate: a rotational speed of the internal combustion engine; a torque of the internal combustion engine; a composition of a fuel/air mixture for the operation of the internal combustion engine; a mass flow of the exhaust gases of the internal combustion engine; and/or a temperature of the internal combustion engine and/or of the catalytic converter and/or of the exhaust gases. The parameter values can be determined by means of one or more vehicle sensors. The planning emission value can then be determined on the basis of the parameter values of the one or more operating parameters. The planning emission value can be predicted with increased accuracy by taking into account operating parameters of the internal combustion engine and/or of the catalytic converter.

The control unit can be configured to determine a raw emission value of the internal combustion engine for the planning time period on the basis of an engine model of the internal combustion engine. In this context, the raw emission value indicates the quantity of emissions in the exhaust gases (directly) at the outlet of the internal combustion engine. The engine model can be designed here to assign a raw emission value to the parameter values of one or more operating parameters of the internal combustion engine. The engine model can be determined within the scope of tests on the vehicle or the vehicle type in advance and stored in a memory unit of the vehicle. By taking into account an engine model it is possible to predict the planning emission value with increased accuracy.

The raw emission value of the internal combustion engine for the planning time period can be determined initially for a multiplicity of time steps within the planning time period here. In particular, a multiplicity of partial raw emission values can be determined for a multiplicity of times steps. The multiplicity of partial raw emission values can then be combined (e.g. added) in order to determine a raw emission value for the entire planning time period.

In addition, the control unit can be configured to determine the planning emission value from the raw emission value on the basis of a catalytic converter model for a catalytic converter of the vehicle. The catalytic converter model can be designed here to assign a planning emission value to a raw emission value while taking into account the parameter values of one or more operating parameters of the catalytic converter. The catalytic converter model can be determined within the scope of tests on the vehicle or for the vehicle type in advance and stored in a memory unit of the vehicle. By taking into account a catalytic converter model it is possible to predict the planning emission value with increased accuracy.

The control unit can be configured to determine navigation data relating to a planned route of the vehicle in the planning time period. The planning emission value can then also be determined and/or predicted in accordance with the navigation data. The accuracy of the planning emission value which is determined can therefore be increased.

Alternatively or additionally, an emission-relevant function can be operated in accordance with the navigation data within the planning time period. For example it is possible to check whether conditions which are advantageous for the operation of an emission-relevant function (e.g. in order to operate the emission-relevant function with the lowest possible quantity of emissions) are present on the planned route, or whether the planned route permits particularly favorable operating parameters and/or operating ranges of an emission-relevant function. If this is the case, the emission-relevant function can be operated within the planning time period. On the other hand, the operation of the emission-relevant function can, if appropriate, be shifted to a later point in time.

The control unit can be configured to determine planning emission values sequentially for a sequence of successive planning time periods. The multiplicity of emission-relevant functions can then be operated in the respective planning time periods as a function of the respectively determined planning emission values. In this context, the priorities of the emission-relevant functions can be at least partially different for different planning time periods. For example, the priority of a diagnostic function can rise with progressive planning time periods if the diagnostic function has not been activated in the preceding planning time periods. Therefore, reliable operation of the exhaust system of the vehicle and compliance with emission limits can be ensured over a relatively long time period.

According to a further aspect, a (further) control unit for a vehicle is described. The abovementioned aspects relating to a control unit can also be applied to the (further) control unit. Furthermore, aspects of the (further) control unit can be applied to the abovementioned control unit.

As already stated above, the vehicle comprises an internal combustion engine which generates exhaust gases when fuel is burnt. Furthermore, the vehicle comprises at least one emission-relevant function, the operation of which increases a quantity of emissions in the exhaust gases. The emission-relevant function can be here, in particular, a basic function, a function for shifting the load point and/or an emission function. In particular, the emission-relevant function may not be a diagnostic function.

An emission-relevant function can have an optimum operating range with respect to the quantity of emissions brought about by the operation of the emission-relevant function. In particular, the emission-relevant function can have an operating range with specific parameter values or parameter value ranges for one or more operating parameters in which the emission-relevant function brings about particularly low emissions in the exhaust gases.

The control unit can be configured to determine whether the emission-relevant function can be operated in the optimum operating range in a planning time period. For this purpose, sensor data from one or more vehicle sensors can be taken into account. For example, a state of the vehicle, in particular of the internal combustion engine and/or of the exhaust system, can be determined on the basis of the sensor data. It can then be determined whether the state of the vehicle permits operation of the emission-relevant function in the optimum operating range.

In addition, the control unit can be configured to operate the emission-relevant function within the planning time period if it has been determined that the emission-relevant function can be operated in the optimum operating range in the planning time period. On the other hand, operation of the emission-relevant function within the planning time period can be prohibited.

It is therefore possible to prioritize, activate and/or limit one or more emission-relevant functions e.g. in accordance with the state of the vehicle. In particular, the operation of an emission-relevant function can be limited to one or more planning time periods in which operation of the emission-relevant function is possible in an optimum operating range which is defined for the emission-relevant function. The emissions of a vehicle can therefore be reduced.

For example, according to a standard operating strategy of the vehicle, the activation of an emission-relevant function (e.g. an overrun cutoff or overrun burbling) can be requested at a specific point in time. The control unit can then check whether the requested emission-relevant function can be operated in the directly following planning time period in the optimum operating range which is defined for the function. Operation of the emission-relevant function can then be prohibited (if appropriate counter to the standard operating strategy) if it is determined that the emission-relevant function cannot be operated in the optimum operating range. Otherwise, the requested operation of the emission-relevant function can be approved.

As already stated above, the limitation of the operation of an emission-relevant function to one or more time periods in which an optimum operating range is possible can be combined with the operation of an emission-relevant function in accordance with a planning emission value. For example, the one or more emission-relevant functions which are taken into account for a planning time period in order to determine the planning emission value can be prioritized in accordance with the operating ranges in which the individual emission-relevant functions can be operated in the planning time period. It is therefore possible to reduced emissions of a vehicle in a particularly effective way.

According to a further aspect, methods corresponding to the control units are described.

According to one further aspect, a vehicle (in particular a road vehicle, e.g. a passenger car, a truck or a motorcycle), which comprises one of the control units described in this document, is described.

According to a further aspect, a software (SW) program is described. The SW program can be configured to be executed on a processor, and as a result to execute one of the methods described in this document.

According to a further aspect, a storage medium is described. The storage medium can comprise an SW program which is configured to be executed on a processor, and as a result to execute one of the methods described in this document.

It is to be noted that the methods, devices and systems described in this document can be used either alone or in combination with other methods, devices and systems described in this document. Furthermore, any aspects of the methods, devices and systems described in this document can be combined with one another in a variety of ways. In particular, the features of the claims can be combined with one another in a variety of ways.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
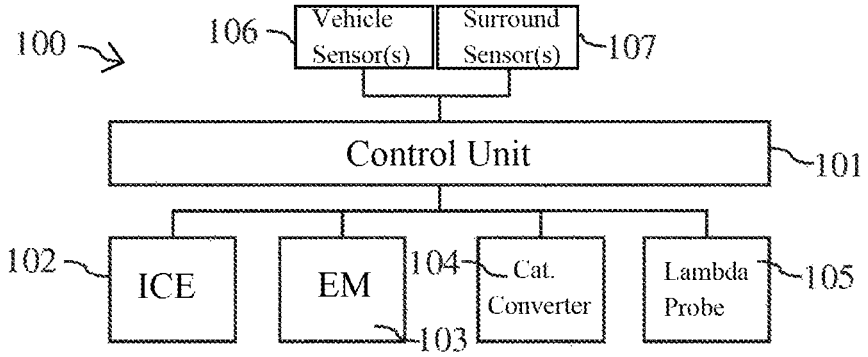
FIG. 1 shows exemplary emission-relevant components of a vehicle.

As already stated, the present document is concerned with optimizing the emissions of pollutants of a vehicle. In this context, FIG. 1 shows exemplary emission-relevant components of a vehicle 100. The vehicle 100 comprises an internal combustion engine 102 (in particular a spark-ignition engine) which is configured to generate mechanical energy for driving the vehicle 100 by burning a fuel (in particular gasoline). During the combustion process, exhaust gases are produced with pollutants such as e.g. nitrogen oxides (in particular nitrogen monoxide), hydrocarbons and/or carbon monoxide. The quantity of pollutants which are produced during the combustion process can depend on different operating modes and/or functions of the internal combustion engine 102. Exemplary basic functions of the internal combustion engine 102 are:

(i) Overrun cutoff of the internal combustion engine 102, i.e. cutting off of the fuel supply if the internal combustion engine 102 is in the overrun mode;

(ii) Scavenging of the internal combustion engine 102, with the result that the inlet valves and the outlet valves of the internal combustion engine 102 are opened simultaneously at least for a certain time, in order to conduct an increased quantity of fresh air into the cylinders of the internal combustion engine 102; and/or (iii) Individual cylinder cutoff of one or more cylinders of the internal combustion engine 102, in order to reduce the fuel consumption of the vehicle 100 when the load is reduced.

The activation of one or more of the abovementioned basic functions of the internal combustion engine 102 can be advantageous e.g. for reducing the fuel consumption. On the other hand, the quantity of expelled pollutants can be increased in certain circumstances (at least temporarily) by the activation of such a function.

The vehicle 100 can comprise an electric machine 103 which is configured to drive the vehicle 100 at least for a certain time. The electrical energy which is necessary to operate the electric machine 103 can be stored in an electrical energy store (not illustrated). The electric machine 103 can be used, on the one hand, to reduce the load of the internal combustion engine 102 by the electric machine 103 providing at least part of the drive power of the vehicle 100. On the other hand, the electric machine 103 can be used to increase the load of the internal combustion engine 102 by the electric machine 103 being driven as a generator by the internal combustion engine 102. The electric machine 103 can therefore be used for actively shifting the load point of the internal combustion engine 102, e.g. to operate the internal combustion engine 102 at a load point with the highest possible efficiency. The function of the shifting of the load point typically has an effect on the quantity of expelled pollutants here.

The vehicle 100, in particular the exhaust system of the vehicle 100, typically comprises a catalytic converter 104 which is configured to reduce the quantity of pollutants which come into the environment from the exhaust system of the vehicle 100. In particular, in the case of a spark-ignition engine, a regulated three-way catalytic converter can convert carbon monoxide into carbon dioxide, hydrocarbons into carbon dioxide and water, and nitrogen monoxide and carbon monoxide into nitrogen and carbon dioxide. In the case of a diesel engine, other catalytic converter configurations can be used to reduce the quantity of pollutants.

The effectiveness of a catalytic converter 104 typically depends here substantially on the composition of the fuel/air mixture in the internal combustion engine 102, i.e. on the lambda value. The vehicle 100 therefore typically comprises a lambda probe 105 which is configured to compare the residual oxygen content in the exhaust gas with the nitrogen content of the current atmospheric air. The lambda probe can be used for lambda control, in order to adjust the composition of the fuel/air mixture to a specific target value (e.g. $\lambda=1$).

One or more diagnostic functions can be made available for checking the catalytic converter 104 and/or the lambda probe 105. For example, the composition of the fuel/air mixture can be changed at certain times (e.g. the portion of fuel can be temporarily increased or reduced) within the scope of a diagnostic function. The activation of a diagnostic function for checking the catalytic converter 104 and/or the lambda probe 105 can therefore bring about a change in the quantity of emissions of pollutants (at least for the diagnostic time period).

A further example of a diagnostic function which can influence the emissions of pollutants is the checking of a fuel ventilation valve via which fuel vapors can be conducted from the fuel tank of the vehicle 100 (typically by means of the sucked-in fresh air) into the internal combustion engine 102.

The effectiveness of a catalytic converter 104 depends typically on the temperature of the exhaust gases to be processed. In particular, after a cold start or during town journeys the exhaust gases of the internal combustion engine 102 may be relatively low over a relatively long time period. The active heating of the catalytic converter 104 and/or of the exhaust gases before they enter the catalytic converter 104 can therefore be made available as an emission-influencing function.

It is therefore possible to make available a multiplicity of emission-influencing or emission-relevant functions in a vehicle 100. The activation of these functions may not be absolutely necessary for the actual driving operation of the vehicle 100 here. For example the internal combustion engine 102 can also be operated without activating the basic functions such as e.g. overrun cutoff, scavenging and/or individual cylinder cutoff, without this adversely affecting (decisively or substantially, according to the circumstances) the actual driving operation of the vehicle 100. This also applies to the abovementioned hybrid functions such as e.g. the shifting of the load point, which occur in a vehicle 100 with hybrid drive. The abovementioned diagnostic functions, such as e.g. functions for checking the catalytic converter 104, the lambda probe 105 or the tank ventilation, should typically be carried out at certain time intervals, but can be shifted in terms of timing where necessary here without as a result adversely affecting the actual driving operation of the vehicle 100. Furthermore, emission functions for influencing the emissions of pollutants, such as e.g. the activation of a catalytic converter heater, can be activated or deactivated without adversely affecting the actual driving operation of the vehicle 100. Moreover, one or more component protection functions can be made available which can be activated for the protection (e.g. for the thermal management) of individual components of the exhaust system of the vehicle 100 (e.g. in order to enable the lambda probe 105 for operation).

The vehicle 100 can comprises a control unit 101 which is configured to determine a planning emission value for a planning time period, wherein the planning emission value indicates the quantity of emissions of pollutants which are planned for the planning time period. The planning time period can comprise e.g. 30, 10 or 5 minutes or 1 minute or fewer. The planning time period can lie in the (immediate) future here.

In order to determine the planning emission value, the raw emissions of the internal combustion engine 102 can be determined. For this purpose it is possible to use an engine model of the internal combustion engine 102 which is configured to calculate the raw emissions of the internal combustion engine 102 as a function of one or more operating parameters of the internal combustion engine 102. Exemplary operating parameters are: a rotational speed of the internal combustion engine 102, a load of the internal combustion engine 102, a temperature of the internal combustion engine 102, a composition of the fuel/air mixture etc. The operating parameters can be determined on the basis of one or more vehicle sensors 106. Furthermore, if appropriate the data of the one or more surroundings sensors 107 can be taken into account, wherein the data of the one or more surroundings sensors 107 can display information relating to the surroundings of the vehicle 100 (e.g. the external temperature, the gradient of a roadway etc.). Furthermore, if appropriate navigation data relating to a route of the vehicle 100 lying ahead can be taken into account in the determination of the operating parameters or in the determination of the raw emissions of the internal combustion engine 102.

Furthermore, a catalytic converter model can be used to determine the planning emission value on the basis of the raw emissions of the internal combustion engine 102. In this context, operating parameters of the catalytic converter 104 (such as e.g. the exhaust gas temperature, the catalytic converter temperature, the exhaust gas mass flow, the lambda value etc.) can be acquired by means of one or more vehicle sensors 106 and taken into account. The catalytic converter model can comprise e.g. characteristic data which indicate which portion of the raw emissions can be converted by the catalytic converter 104. The converted portion depends here on the operating parameters of the catalytic converter 104.

The activation of one or more emission-relevant functions of the vehicle 100 can also be taken into account in the determination of the planning emission value. In particular, it is possible to determine which one or more emission-relevant functions are activated or deactivated during the execution of a standard operating strategy of the vehicle 100 in the planning time period. It is then possible to take into account the influence of the active or inactive emission-relevant functions on the emissions of pollutants during the determination of the planning emission value for the planning time period.

The planning emission value which is determined in this way can then be compared with a reference emission value. The reference emission value can be predefined e.g. by legislators. In particular, it is possible to determine whether the planning emission value determined for the planning time period exceeds the reference emission value or not.

The multiplicity of emission-relevant functions can then be controlled in the planning time period in accordance with the abovementioned comparison, i.e. in particular can be partially activated or deactivated. In particular, it is possible to determine which one or more emission-relevant functions are activated and which are deactivated in the planning time period, in order to ensure that the actual emission value of the vehicle 100 does not exceed the reference emission value in the planning time period. For example, if appropriate one or more emission-relevant functions of the vehicle 100 can be deactivated in the planning time period (counter to the standard operating strategy of the vehicle 100), in order to reduce the emissions of pollutants of the vehicle 100 in the planning time period. Furthermore, if appropriate one or more emission-relevant diagnostic functions can be shifted to a later planning time period in order to reduce the emissions of pollutants by the vehicle 100 in the current planning time period. Furthermore, if appropriate the operating point of the internal combustion engine 102 can be optimized (e.g. by shifting the load point) in order to reduce the emissions of pollutants of the vehicle 100 in the current planning time period. On the other hand, if appropriate the activation of an emission-relevant function, in particular of a diagnostic function, can be brought forward (e.g. if it has been determined that the planning emission value is below the reference emission value). It is therefore possible for active (re)distribution of the emissions of a vehicle 100 among the different planning time periods to be carried out (e.g. in order to ensure that the emissions do not exceed the reference emission value in any of the planning time periods).

The control unit 101 therefore carries out planning of emissions of pollutants by the vehicle 100 for a sequence of successive planning time periods. In this context, the different emission-relevant functions of the vehicle 100 can be prioritized and, if appropriate, distributed among different planning time periods. The object of the planning here can preferably be to ensure that the actual emissions of pollutants does not exceed the reference emission value in any of the planning time periods.

The control unit 101 can therefore be configured to coordinate and/or prioritize all the emission-relevant functions of the vehicle 100 in a superordinate fashion. In this context, driving functions such as e.g. the overrun cutoff can also be taken into account. The current emissions and the emissions which are expected in the future can be included in the coordination of the functions. For this purpose, an emission predictor of the control unit 101 evaluates operating parameters of the vehicle 100 and, in particular, of the internal combustion engine 102 and calculates therefrom an emission profile which extends with a specific time window into the future (e.g. with the planning time period). Navigation data can also be included for the determination of the emission profile.

The emission predictor can prohibit the execution of one or more emission-relevant functions depending on the profile of the calculated emissions.

In this context, if appropriate the respective priority of an emission-relevant function can be taken into account.

Alternatively or additionally, in the case of hybrid systems or mild-hybrid systems (e.g. with 12 V/48 V generators) the operating point of the internal combustion engine 102 can be adjusted or optimized by means of the electric machine 103 with respect to the generation of emissions.

In this way, the execution of an emission-relevant function at an operating point which is optimum for the emission-relevant function can be made possible. In this context, e.g. navigation can be taken into account in order to adapt the operating point of an emission-relevant function in a predictive fashion, in order to reduce the emissions of pollutants which is brought about by the function.

Figure 2:
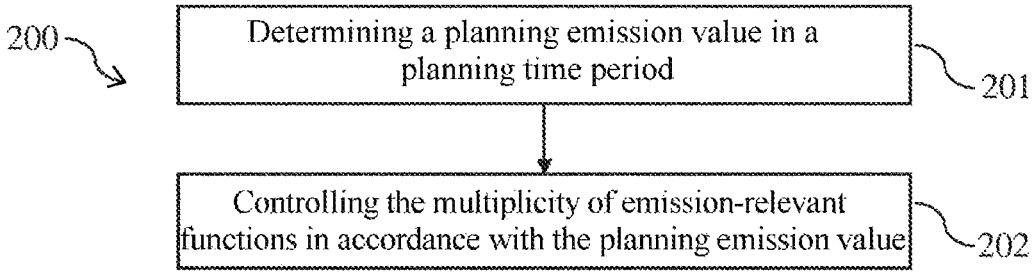
FIG. 2 is a flow chart of an exemplary method for controlling a multiplicity of emission-relevant functions in a vehicle.

FIG. 2 shows a flow chart of an exemplary method 200 for controlling a multiplicity of emission-relevant functions in a vehicle 100. The vehicle 100 comprises an internal combustion engine 102 which generates exhaust gases when a fuel is burnt. Furthermore, the vehicle 100 comprises a multiplicity of emission-relevant functions by which a quantity of emissions in the exhaust gases can be changed.

The method 200 comprises determining 201 a planning emission value for a planning time period, wherein the planning emission value indicates the quantity of emissions in the exhaust gases in the planning time period (in particular the quantity of emissions which passes into the environment from the vehicle 100). Furthermore, the method 200 comprises operating 202 the multiplicity of emission-relevant functions within the planning time period as a function of the planning emission value.

In particular, the multiplicity of emission-relevant functions can be regulated in accordance with the planning emission value. For example, planning emission values can be respectively determined for a sequence of planning time periods. The multiplicity of emission-relevant functions can be operated in the sequence of planning time periods in such a way that the planning emission values are regulated to a specific reference emission value along the sequence of planning time periods (e.g. with the result that the reference emission value is not exceeded but, if appropriate, is undershot).

A control unit 101 and a method 200 for a vehicle 100, by which available information relating to the internal combustion engine 102, the vehicle 100 and/or a navigation system are evaluated, are therefore described. The control unit 101 can then monitor and regulate the generation of emissions, inter alia, on the basis of the priorities of different emission-relevant functions. The compliance with emission limiting values during the driving operation can therefore be reliably ensured. Furthermore, the expenditure on development can be reduced, since owing to the closed control loop automatic compliance with the reference emission values occurs and therefore dedicated optimization of a standard operating strategy of the vehicle 100 in respect of specific driving cycles can be eliminated.

The present invention is not limited to the exemplary embodiments shown. In particular it is to be noted that the description and the figures are intended to illustrate only the principle of the proposed methods, devices and systems.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for a vehicle having an internal combustion engine that generates exhaust gases when fuel is burnt, comprising:

a control unit for the vehicle, the control unit being configured to:

determine a reference emission value that indicates a maximum permissible or desired quantity of emissions in the exhaust gases within a planning time period;

determine a plurality of planning emission values for a plurality of successive planning time periods, wherein the planning emission value indicates a quantity of emissions contained in the exhaust gases in the planning time period;

prioritize a multiplicity of emission-relevant functions;

distribute the multiplicity of emission-relevant functions among the plurality of successive planning time periods based on the respective priorities such that the planning emission value for each of the plurality of planning time periods does not exceed the reference emission value of the respective time period; and operate the multiplicity of emission-relevant functions within the plurality of successive planning time periods as a function of the planning emission value, wherein the quantity of emissions contained in the exhaust gases are changeable by the multiplicity of emission-relevant functions.

2. The apparatus according to claim 1, wherein the control unit is further configured to:

determine a raw emission value of the internal combustion engine for the planning time period on the basis of an engine model of the internal combustion engine, wherein the raw emission value indicates the quantity of emissions in the exhaust gases at an outlet of the internal combustion engine; and determine the planning emission value from the raw emission value on the basis of a catalytic converter model for a catalytic converter of the vehicle.

3. The apparatus according to claim 1, wherein the control unit is further configured to:

determine parameter values of one or more operating parameters of the internal combustion engine and/or of a catalytic converter of the vehicle for the planning time period; and determine the planning emission value on the basis of the parameter values of the one or more operating parameters, wherein the one or more operating parameters comprise:

a rotational speed of the internal combustion engine;

a torque of the internal combustion engine;

a composition of a fuel/air mixture for operation of the internal combustion engine;

a mass flow of the exhaust gases of the internal combustion engine; and a temperature of the internal combustion engine, of the catalytic converter, and/or of the exhaust gases.

4. The apparatus according to claim 1, wherein the control unit is further configured to:

determine the planning emission value on the basis of a standard operating strategy of the vehicle for the planning time period, wherein the standard operating strategy describes a standard mode of operation of the multiplicity of emission-relevant functions; and operate one or more of the multiplicity of emission-relevant functions in accordance with the planning emission value, in a way which deviates from the standard operating strategy.

5. The apparatus according to claim 1, wherein at least one of the multiplicity of emission-relevant functions has a different priority for one planning time period of the plurality of successive planning time periods than another planning time period of the plurality of successive time periods.

6. The apparatus according to claim 1, wherein in accordance with the planning emission value, (i) an emission-relevant function is deactivated or activated; and/or (ii) an operating parameter and/or an operating range of an emission-relevant function is adapted;

such that an actual emission value does not exceed the reference emission value in the planning time period.

7. The apparatus according to claim 1, wherein the control unit is further configured to:

determine navigation data relating to a planned route of the vehicle in the planning time period; and determine the planning emission value in accordance with the navigation data; and/or operate an emission-relevant function in accordance with the navigation data within the planning time period.

8. The apparatus according to claim 1, wherein the multiplicity of emission-relevant functions comprises one or more of:

(1) one or more basic functions for operating the internal combustion engine;

(2) a function for shifting a load point of the internal combustion engine;

(3) one or more diagnostic functions for checking a component of an exhaust system of the vehicle;

(4) one or more emission functions for adapting an operating parameter of a component of the exhaust system of the vehicle; or (5) one or more protective functions for protecting a component of the exhaust system of the vehicle.

9. The apparatus according to claim 8, wherein the one or more basic functions for operating the internal combustion engine are selected from a group comprising:

an overrun cutoff of the internal combustion engine;

scavenging of the internal combustion engine;

an individual cylinder cutoff of the internal combustion engine;

switching the internal combustion engine to lean operation;

overrun burbling of the internal combustion engine;

tank ventilation; and a torque intervention in the internal combustion engine by a transmission and/or by a secondary consumer.

10. The apparatus according to claim 8, wherein the function for shifting the load point of the internal combustion engine is carried out via an electric machine of the vehicle.

11. The apparatus according to claim 8, wherein one or more diagnostic functions comprise one or more of:

a lambda probe;

a catalytic converter; or a tank ventilation.

12. The apparatus according to claim 8, wherein the one or more emission functions for adapting the operating parameter of the component of the exhaust system of the vehicle comprises one or more of:

a heating function for the catalytic converter and/or for the exhaust gases of the internal combustion engine;

an active particle filter regeneration;

an adaptation of the formation of the fuel/air mixture;

an adaptation in an air path of the vehicle; or an adaptation of a trim control.

13. The apparatus according to claim 11, wherein the one or more protective functions for protecting the component of the exhaust system comprises a heating function and/or an enable function for the lambda probe.

14. The apparatus according to claim 1, wherein the priority of one emission-relevant function of the multiplicity of emission-relevant functions increases with successive planning time periods of the plurality of successive planning time periods when the one emission-relevant function has not been activated in preceding planning time periods.

15. The apparatus according to claim 1, wherein the control unit is further configured to:

compare a planning emission value of an earlier planning time period with the reference emission value of the earlier planning time period;

based on the comparison, shift an emission-relevant function form the earlier planning time period to a subsequent second planning time period to reduce the planning emission value of the earlier planning time period.

16. An apparatus for a vehicle having an internal combustion engine that generates exhaust gases when fuel is burnt, comprising:

a control unit configured to:

determine whether a first emission-relevant function is operable in a more optimum operating range than a second emission-relevant function in a planning time period based on sensor data from one or more sensors of the vehicle, wherein operation of the emission-relevant function increases a quantity of emissions in the exhaust gases, and further wherein the emission-relevant function has the optimum operating range with respect to the quantity of emissions brought about by operation of the emission-relevant function; and operate the first emission-relevant function within the planning time period if the determination has been made that the first emission-relevant function is operable in the more optimum operating range in the planning time period.

17. The apparatus according to claim 1, wherein the control unit is further configured to:

compare a planning emission value of an earlier planning time period with the reference emission value of the earlier planning time period;

based on the comparison, shift an emission-relevant function from a subsequent planning time period to the earlier planning time period.

18. The apparatus according to claim 1, further comprising:

an electric machine configured to drive the vehicle, wherein the control unit is further configured to:

compare a planning emission value of a planning time period with the reference emission value of the planning time period; and operate the electric machine to increase or decrease, based on the comparison, a load of the internal combustion engine to reduce the planning emission value to be equal to or less than the reference emission value of the planning time period.

19. The apparatus according to claim 17, wherein the emission-relevant function shifted from the subsequent planning time period is of a greater priority than another emission-relevant function from the subsequent planning time period.

20. The apparatus according to claim 1, wherein the multiplicity of emission-relevant functions are prioritized such that emission-relevant functions that operate in a more optimum operating range during the planning time period are prioritized over emission-relevant functions that operate in a less optimum operating range during the same planning time period.

* * * * *